US006739348B2

(12) United States Patent
Inch et al.

(10) Patent No.: US 6,739,348 B2
(45) Date of Patent: May 25, 2004

(54) POT AND PAN WASHING MACHINE

(75) Inventors: John Inch, Kansas City, MO (US); John W. Cantrell, Leawood, MO (US); Mark Churchill, Blue Springs, MO (US); Dave Stockdale, Lee's Summit, MO (US)

(73) Assignee: Metcraft, Inc., Grandview, MO (US)

( * ) Notice: Subject to any disclaimer, the term of this patent is extended or adjusted under 35 U.S.C. 154(b) by 0 days.

(21) Appl. No.: 09/947,484

(22) Filed: Sep. 6, 2001

(65) Prior Publication Data

US 2003/0041887 A1 Mar. 6, 2003

(51) Int. Cl.[7] ..... B08B 3/04
(52) U.S. Cl. ..... 134/186; 134/195; 134/199
(58) Field of Search ..... 134/56 D, 57 D, 134/58 D, 104.3, 108, 194, 195, 198, 199, 186

(56) References Cited

U.S. PATENT DOCUMENTS

| | | | | |
|---|---|---|---|---|
| 4,730,630 A | * | 3/1988 | Ranft | 134/111 |
| 4,773,436 A | | 9/1988 | Cantrell et al. | 134/108 |
| 5,464,033 A | | 11/1995 | Hartnell | 134/105 |
| 5,660,194 A | | 8/1997 | Sanders | 134/57 R |
| 5,682,625 A | * | 11/1997 | Leaverton et al. | 4/541.1 |
| 5,775,347 A | | 7/1998 | Hoover et al. | 134/56 D |
| 5,810,036 A | | 9/1998 | Hoover et al. | 134/107 |
| 5,927,309 A | | 7/1999 | Hoover et al. | 134/195 |
| 6,164,301 A | | 12/2000 | McFadden et al. | 134/200 |
| 2002/0108638 A1 | * | 8/2002 | Bigott | 134/18 |

* cited by examiner

*Primary Examiner*—Randy Gulakowski
*Assistant Examiner*—Joseph Perrin
(74) *Attorney, Agent, or Firm*—Sonnenschein Nath & Rosenthal LLP

(57) ABSTRACT

An improved pot and pan washing machine is provided including wash tank, a self-draining parallel flow pump connected to the wash tank, a self-cleaning intake manifold within the wash tank, flush mounted jet nozzles within the wash tank, and a non-welded field joint for connecting two portions of the washing machine together as a single unit. The pump is located on a side of the wash tank. Fluid enters the pump in a first direction and is discharged in a second direction that is substantially parallel to the first direction. The discharge fluid is unobstructed as it enters an outlet manifold located along the rear wall of the wash tank. Directional tubes of the nozzles then divert the fluid from the outlet manifold into jet streams that are directed towards the bottom wall of the wash tank. The jet streams skim across the top of the intake manifold to blow away debris. The intake manifold is located along the rear wall of the wash tank, decreasing vacuum and making the manifold scalable to varying sizes of the wash tank. The nozzles are flush mounted to increase the effectiveness of the jet stream in impacting objects located near the rear wall of the wash tank.

19 Claims, 4 Drawing Sheets

POT AND PAN WASHING MACHINE

FIELD OF THE INVENTION

The present invention relates to improvements in a pot and pan washing machine. More specifically the present invention relates to improvements within the wash tank portion of a pot and pan washing machine, including an improved pump, improved intake manifold and improved jet nozzles for the wash tank. Additionally, the present invention relates to an improved joint and method for connecting two separate portions of a pot and pan washing machine into a single unit.

BACKGROUND OF THE INVENTION

Pot and pan washing machines, of the type used in restaurants, institutions and other eating facilities often involve a large wash tank or basin in which water is circulated about the pots and pans to provide a washing action. One such machine is described in U.S. Pat. No. 4,773,436 issued to Cantrell et al., the specification of which is incorporated herein by reference. The machine of Cantrell includes a wash tank with jets located at an elevated position along the rear wall of the wash tank. The tank is filled with water to a level above the position of the jets. Pots and pans are placed in the wash tank, and a pump is activated to draw water from within the wash tank and direct it through the jets to create a jet stream. Each jet directs its jet stream toward the bottom wall of the wash tank, the bottom wall then deflects the jet stream upward and towards the front wall of the tank. The front wall then deflects the upward moving jet stream towards the rear wall of the tank, and the rear wall deflects the jet stream downward and back towards the front wall along the bottom wall. The combination of deflections of the jet stream from the bottom, front and rear walls provides a rolling washing action within the wash tank.

The basic components of the wash tank of the pot and pan washing machine of the prior art are shown in FIG. 1. Wash tank 10 includes side walls 12 and 14, rear wall 16, front wall 18 and bottom wall 19. A pump can be attached to either side wall; in the embodiment shown in FIG. 1, pump 50 is attached to right sidewall 14. An impeller located within pump 50 is driven by electric motor 56. The impeller draws fluid into pump inlet 52 through an intake port (not shown) located in sidewall 14. The fluid is then discharged from the pump through pump outlet 54 and into outlet manifold 60. Outlet manifold 60 includes a ninety degree turn, and several other turns, to direct the fluid across the back side of rear wall 16 and out jet nozzles 20 which are protruding through and extending from rear wall 16. The intake port associated with pump inlet 52 is covered by perforated intake manifold 30. Intake manifold 30 includes handle 36 and is removably supported within wash tank 10 for easy cleaning. Intake manifold 30 fits tightly between outer runner 32 and inner runner 34, each of which extends vertically from bottom wall 19. Heating element 40 is positioned between intake manifold 30 and sidewall 14 for its protection and to maximize the use of space.

Although the prior art pot and pan washing machine disclosed in U.S. Pat. No. 4,773,436 provides an exceptional wash action, many of the components discussed above hinder the overall efficiency and performance of the machine. Several of the components of the prior art machine that hinder performance and efficiency are the pump, the intake manifold and the jet nozzles.

As discussed above, the pump of the prior art draws fluid in through pump inlet 52 in a first direction and then discharges the fluid in a direction perpendicular to the inlet direction. The path of the fluid being discharged from pump 50 must be diverted ninety degrees in a first direction, then upward and sideways across rear wall 16 to reach jet nozzles 20. Diverting the water path requires a great deal of energy, which significantly reduces the efficiency of the pump. Furthermore, a substantial amount of additional outlet manifold construction is necessary to effect the diversion of the fluid path. This additional manifold construction increases the overall cost of producing the pot and pan washing machine. Thus it is desirable to provide an improved pump for a pot and pan washing machine that streamlines the fluid path of the machine.

Another disadvantage of the pump of the prior art is that motor 56 mounts orthogonal to sidewall 14. This increases the overall footprint of the machine from side to side. As most pot and pan washing machines are of substantial length due to the use of multiple sink basins, it is of great importance to reduce the overall footprint as much as possible to maximize the use of space in a kitchen. If a pump could be designed to orient the pump motor parallel to the side of the wash tank, the side to side footprint of the machine could be reduced, thereby maximizing usable space within the kitchen.

Additionally, in the event that motor 50 requires servicing, it must be removed axially from the pump. This requires a substantial amount of space to the side of the machine to facilitate the motor removal. Unfortunately, most kitchens have a limited amount of space, and the already large footprint of the pot and pan washing machine significantly restricts the amount of unused space allotted to the side of the machine. Therefore, it is desirable to provide a pump for a pot and pan washing machine which can be removed in a direction parallel to the side wall of the machine, rather than perpendicular thereto. Additionally, it is desirable to provide such a pump, without the need for an intricate manifold arrangement.

Another component of the pot and pan machine that reduces the overall efficiency and performance of the machine is the intake manifold. Intake manifold 30 is designed to be positioned along the side of the wash tank, reducing the usable wash area within the wash tank. Also, because water is being pulled toward the side of the wash tank, pots and pans within the wash tank will tend to migrate toward the intake side. This pot migration is undesirable because it reduces the effect of the wash action of the machine as pots and pans are clumped together along one side.

Furthermore, the prior art intake manifold is not scalable. This is because, generally, the size of the wash tank is increased by increasing the length from side to side of the tank without changing the front to back width which makes up the width of intake manifold 30. As the size of the wash tank increases, so does the required flow rate of the pump. This results in an increased draw through the intake, thereby increasing the effects of pot migration and increasing the amount of debris collected by the intake manifold. Therefore, it is desirable to provide a scalable intake manifold that reduces the effect of pot migration and that does not result in increased manifold vacuum when the length of the wash tank is increased.

Another drawback of the prior art manifold is related to the purpose of the manifold, which is to prevent debris in the wash tank from reaching the pump. Much of this debris will be drawn towards and collected by the intake vacuum. Thus, intake manifold 30 is removable to allow for routine cleaning of the debris from the manifold. If the manifold is not routinely cleaned, the efficiency and performance of the pot and pan washing machine will be significantly inhibited. Therefore, it is desirable to provide an intake manifold that is essentially self cleaning.

One final component of the prior art machine is the jet nozzle. Jet nozzle 20 protrudes from rear wall 16 of the pot and pan washing machine. Thus, the effectiveness of the jet stream on objects near the rear wall of the machine is greatly reduced since the jet stream directly exiting the nozzle initiates in a position away from the rear wall. Objects near the rear wall will only be impacted by the jet stream after it has been deflected back to the rear wall from the front wall. Therefore, it is desirable to provide a jet nozzle design that will permit the jet stream exiting the nozzle to more immediately impact objects located near the rear wall of the washing machine.

In addition to the wash tank, the pot and pan washing machines systems of the prior art usually include additional sink basins or work surfaces for 1) scraping and scrapping, 2) rinsing and 3) sanitizing. All basins or work areas of a washing machine system are preferably positioned along side of each other in their order of use for more efficient operation of the washing machine (the preferred order of use is scrapping/scrapping, washing, rinsing, sanitizing). Additionally, it is often more efficient, and provides a more aesthetically pleasing appearance, to construct the entire pot and pan washing machine as a single unit at the factory. Unfortunately, such is often impossible due to installation and transportation limitations.

Very few kitchens have entrances large enough to make installation of a four basin washing machine system as a single unit practical. Therefore most pot and pan washing machines are constructed as a two-part (or more as necessary) unit which is assembled onsite during installation. As the pot and pan washing machine is preferably constructed of stainless steel, the preferred method for joining two sections of the machine into a single unit is to weld the sections together. While welding is a rather routine method of construction at the factory, it is not very practical for onsite assembly and installation. This is due to the difficulty of transporting and operating proper welding and grinding equipment onsite to make a smooth weld. Therefore, seems that are welded onsite generally tend to have a less than desirable appearance.

An alternative to welding two sections of a washing machine system together is to bolt the two sections together. Most often a bolted connection is as unattractive as, or even more unattractive than, a poorly welded seem. Additionally, because a bolted connection results in a slight gap between the two sections of the washing machine system in which debris may collect, NSF standards require the inclusion of a two inch gap between the sections to facilitate cleaning. This results in a even greater reduction in the aesthetic appearance of the washing machine system and increases the size of the footprint of the system, or else reduces the usable volume of the basins. Therefore it is desirable to develop an attractive, non-welded field joint for assembling multiple components of a washing machine system into a single unit having no gaps between the joined components.

SUMMARY OF THE INVENTION

A principal object of the present invention is to provide a cost efficient pot and pan washing machine having exceptional efficiency and performance characteristics. Another object of the present invention is to increase the efficiency and performance of a pot and pan washing machine through the use of an inventive pump. Yet another object of the present invention is to increase the efficiency and performance of the pot and pan washing machine through the use of an inventive intake manifold. Another object of the instant invention is to further increase the efficiency and performance of the pot and pan washing machine through the use of an inventive jet nozzle. A further object of the instant invention is to increase the efficiency of installation of the pot and pan washing machine through the use of an inventive field joint.

According to the above described objects of the instant invention, a pot and pan washing machine is provided including:

- a wash tank including a bottom wall, a rear wall, a front wall and two side walls extending upwardly from said bottom wall;
- an intake port in one of said side walls, said intake port being adjacent to said bottom and rear walls;
- an outlet manifold on said rear wall;
- a self-draining parallel flow pump including:
  - a pump inlet associated with said intake port, said pump inlet having an intake path in a first direction, and
  - a pump outlet associated with said outlet manifold, said pump outlet having an outlet path in a second direction, said second direction being substantially parallel to said first direction;
- at least one jet nozzle in association with said outlet manifold to expel at a predetermined angle a jet stream of fluid from said outlet manifold, said jet nozzle including:
  - a directing tube flush connected to said rear wall and extending into said outlet manifold; and
- a perforated intake manifold within said wash tank positioned within a portion of the jet stream of said jet nozzle and positioned to cover said intake port, said intake manifold including an upper portion extending in away from said rear wall towards said front wall at a predetermined downward angle towards said bottom wall, and said predetermined downward angle of said upper portion of said intake manifold corresponds to the predetermined angle of the jet stream of said nozzle.

The inventive pump features a generally helical housing, having an inlet direction generally parallel to the outlet or discharge direction. The parallel flow of the pump increases the efficiency of the pump and thus the pot and pan washing machine by streamlining the fluid path to reduce the amount of diversion of the fluid path required within the machine. In addition to increasing efficiency of operation of the machine, the use of a parallel flow pump increases the cost efficiency of producing the pot and pan washing machine by significantly reducing the amount of additional manifold tubing required to divert the fluid path.

The generally helical design of the pump housing of the instant invention permits the pump motor to be mounted parallel to the side of the pot and pan washing machine. By mounting the pump motor in this manner, the side to side footprint of the pot and pan washing machine is significantly reduced. Additionally, the orientation of the motor relative to the housing permits easy removal of the pump motor from the pump housing, even in confined spaces, because the pump motor is removed in a direction parallel to the side of the pot and pan washing machine.

Another object of the instant invention is to provide an improved pump that increases sanitation and improves pump life. In accordance with this objective, the pump of the instant invention is self-draining. The generally helical housing of the inventive pump includes a raise volute and a lower intake chamber. An intake port, or pump inlet, is located in the chamber, and an outlet port, or pump outlet, is located in the volute. A portion of the pump inlet comprises the lower most position of the pump housing, permitting fluid to flow, by gravity, from the chamber through the pump inlet and into the wash tank. A drainage passage extends from the lower most portion of the raised volute to the lower chamber, allowing for complete drainage of the volute into the chamber and thereby into the wash tank.

The intake manifold of the instant invention is positioned along the length of the rear wall of the washing machine. This position provides several unique advantages to that of the prior art. Firstly, the intake manifold is positioned in relatively dead space along the bottom of the rear wall of the wash tank, rather than in usable wash space along the side wall of the wash tank. This space is considered "dead" space because it is the last space impacted by the deflected jet stream. Furthermore, since the side to side length of the wash tank is usually greater than the front to back width, the intake manifold of the instant invention can provide the same intake area as the prior art manifold while having a lower profile. Additionally, the inventive intake manifold can be contoured to assist in the rolling wash action of the pot and pan washing machine by gradually deflecting the path of the jet stream downward and forward. In the prior art pot and pan washing machine, the seem between the rear wall and the bottom wall is filleted or rolled to assist in the rolling wash action of the machine. The intake manifold of the instant invention can be used to perform this function.

Positioning the intake manifold along the rear wall of the washing machine allows the manifold to be scalable to any size machine. This is because the size of the machine is usually increased or decreased through the addition or removal of jets along the length of the rear wall of the machine and the increase or decrease of the rear wall length. The width from front to back of the machine is usually unaltered regardless of machine size. Thus, as the length of the machine increases, so does the length of the intake manifold and the proportional intake area. As higher volume motors are used with the larger wash tanks, the intake vacuum will remain unchanged due to the increased intake area.

Another advantage of the position of the intake of the instant invention is that the intake area can be significantly increased from the intake area of the prior art machine. This reduces the suction or vacuum levels, resulting in more efficient cleaning of pots and pans and elimination of pot migration. The reduced suction will also reduce the amount of debris that collects on the intake manifold, virtually eliminating the need to routinely remove and clean the manifold as required by the design of the prior art. Any minor pot migration that might exist will be toward the rear wall, eliminating the clumping effect associated with the prior art. Additionally, pot migration toward the rear wall will be counterbalanced with the force of the jet stream and the rolling wash action, resulting in a more efficient wash action.

The intake manifold of the instant invention is positioned within a portion of the jet stream emanating from the jet nozzle. This effectively blows off any debris that may collect on the intake manifold, making the manifold virtually self-cleaning. The use of flush mounted jet nozzles assists in this cleaning action by positioning the full force of the initial, non-deflected jet stream closer to the rear wall of the machine than that provided by the prior art. The angle of the intake manifold roughly corresponds to the angle of the jet stream emanating from the jet nozzle to prevent substantial deflection of the jet stream by the intake manifold before the jet stream reaches the bottom wall of the wash tank.

An inventive field joint and method is provided for assembling multiple portions or segments of the pot and pan washing machine into a single unit without the use of either a welded or a bolted connection. This inventive field joint increases the usable basin volume within a given footprint by eliminating the NSF required gap. The inventive field joint includes a hemmed edge located along an edge of a generally flat side of a first sink basin, and a lip located along an edge of a generally flat side of a second sink basin. A jog extends inward from one of the generally flat sides of the first or second sink basins such that the edge of the associated sink basin extends inward of the generally flat side of that sink basin. The lip is positioned over the hemmed edge forcing the generally flat sides of the first and second sink basins into tight engagement with one another. The inwardly extending jog assures tight engagement of the generally flat sides of the sink basins without any gap therebetween; thus providing an attractive, non-welded seem. The outer sides of the sink basins that have been joined together can be covered with a decorative trim piece to enhance the aesthetically pleasing appearance of the washing machine.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DESCRIPTION OF THE PREFERRED EMBODIMENT

Figure 1:
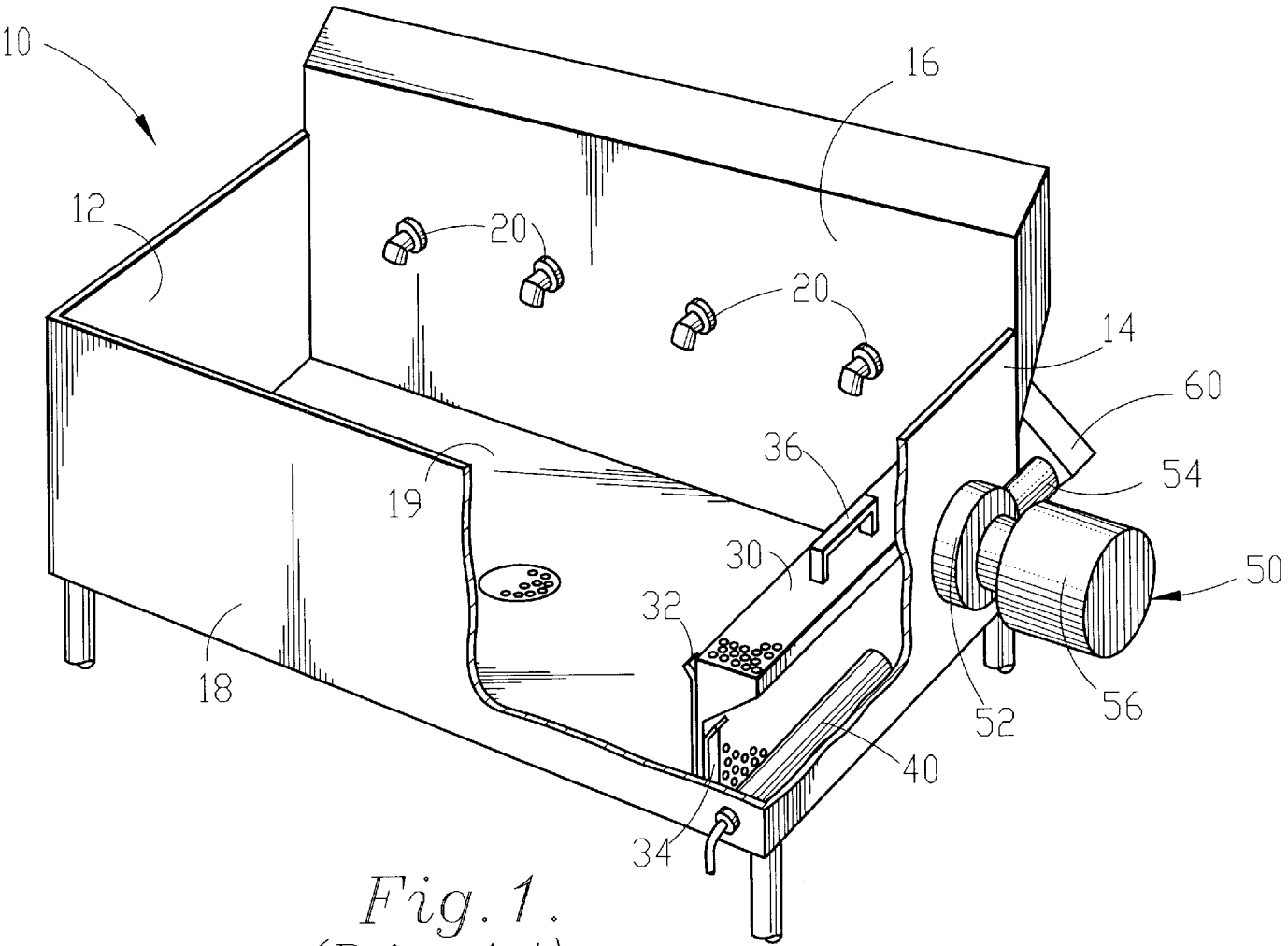
Fig. 1. (Prior Art)
FIG. 1 is a perspective view from above of a prior art pot and pan washing machine with a portion of the front and one side wall of the wash tank cut away to better illustrate certain interior construction details.

Referring to the drawing figures, therein is shown an optimum form of the subject pot and pan washing machine with essentially all features usable to increase performance, versatility and efficiency therewithin. Preferred embodiments of the present invention are hereinafter described with reference to the accompanying drawings.

The operation of the pot and pan washing machine described hereinafter is substantially similar to the operation of the prior art machine described above. The instant invention provides significant features that increase the performance, versatility and efficiency of the pot and pan washing machine.

Figures 2, 4, 7:
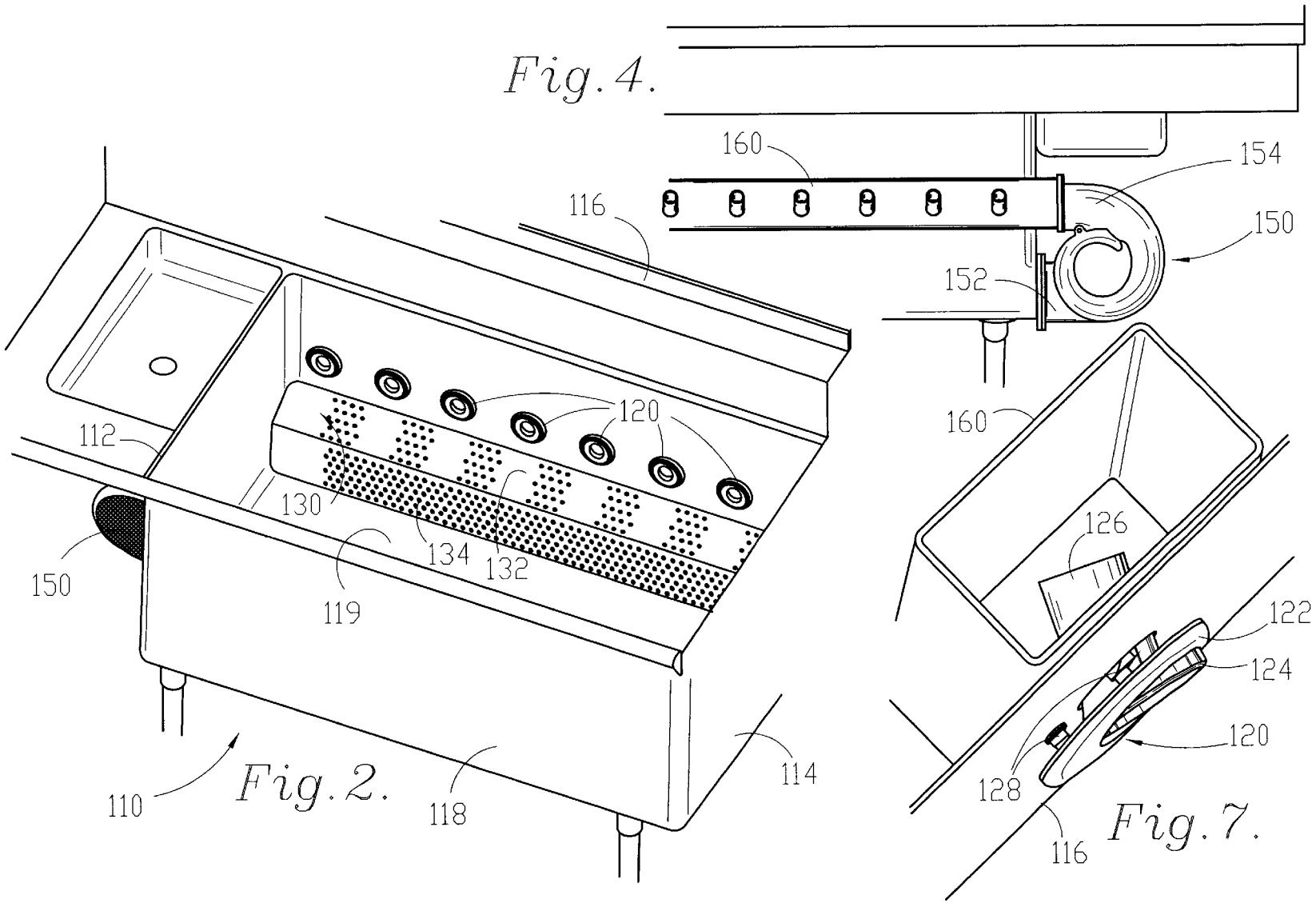
FIG. 2 is a fragmentary perspective view from above of the pot and pan washing machine of the instant invention.
FIG. 4 is a fragmentary rear elevation view of the pot and pan washing machine of the instant invention.
FIG. 7 is a detailed perspective view taken from the side of a flush mounted jet nozzle for the pot and pan washing machine shown in FIG. 2, showing the outlet manifold and rear wall of the washing machine in section and partial cutaway.

Referring to FIG. 2, a preferred embodiment of the wash tank of the inventive pot and pan washing machine is shown. The wash tank/basin of the instant invention is constructed in essentially the same manner as the wash tanks of the prior art. Wash tank 110 includes left side wall 112, right side wall 114, rear wall 116, front wall 118 and bottom wall 119 constructed in the same or similar manner, and of the same or similar materials as the wash tank of the prior art. FIG. 2 shows the unique components of the pot and pan washing machine as they are located in association with wash tank 110. Parallel flow pump 150 is attached to left side wall 112 in the embodiment shown in FIG. 2. As has been discussed with respect to the prior art, pump 150 can be attached to either left side wall 112 or right side wall 114 of wash tank 110. Flush mounted jet nozzles 120 are mounted along rear wall in essentially the same location as the jet nozzles of the prior art discussed above. Intake manifold 130 is mounted within wash tank 110 along the bottom portion of rear wall 116, below nozzles 120.

Parallel Flow Pump

Figures 3, 6, 8:
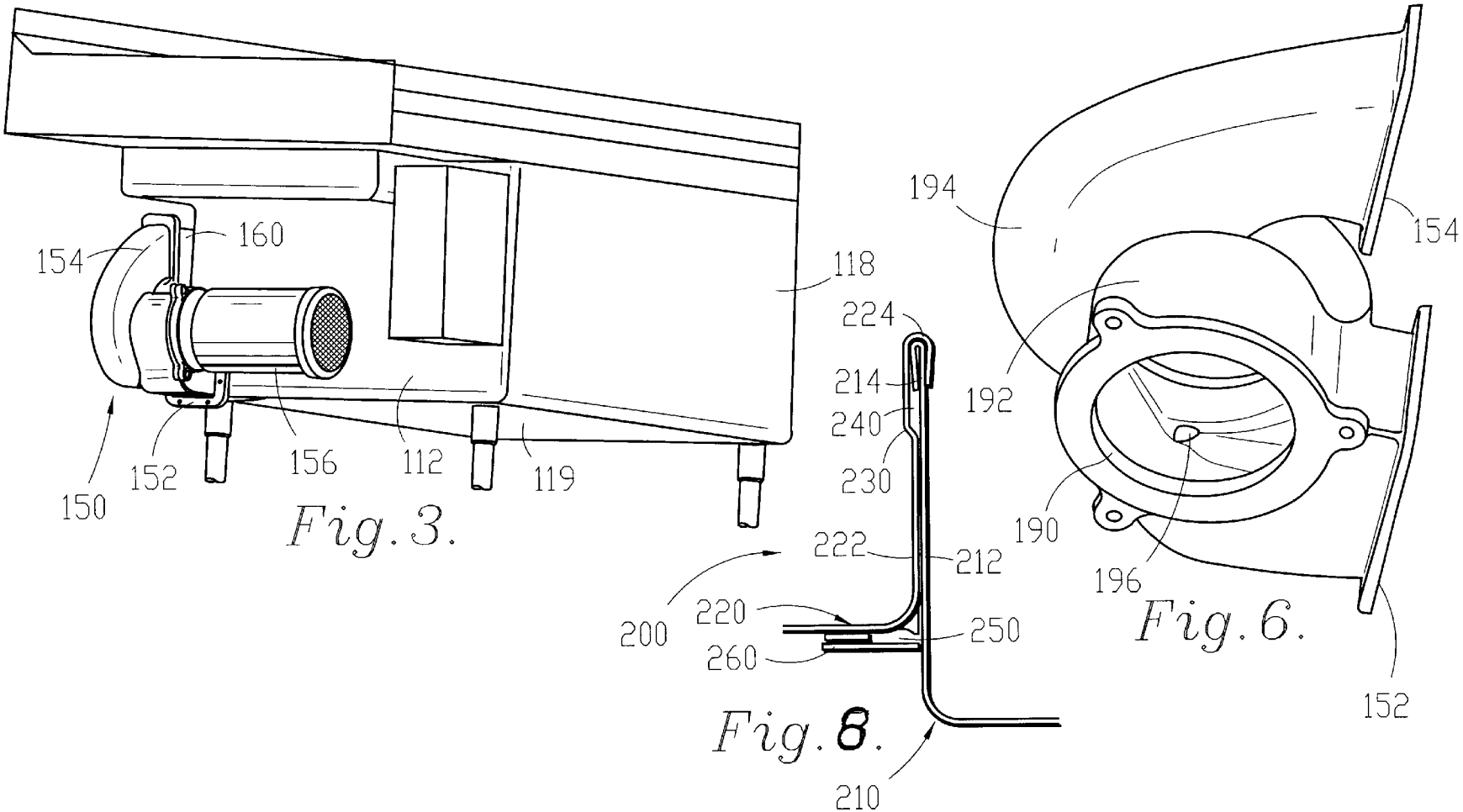
FIG. 3 is a fragmentary perspective elevation view taken from the left hand side of the pot and pan washing machine shown in FIG. 2.
FIG. 6 is a perspective view taken from above of the housing of the pump shown in FIG. 5, showing the interior of the pump housing.
FIG. 8 is a fragmentary sectional view showing a non-welded field joint for connecting multiple portions of a pot and pan washing machine.

FIGS. 3 and 4 show pump 150 mounted to the exterior of wash tank 110. Although pump 150 of the preferred embodiment is constructed entirely of stainless steel; any suitable material can be used. Pump inlet 152 associates with and connects to an intake port (not shown) passing through right side wall 112. Pump outlet 154 associates with and connects to outlet manifold 160. Outlet manifold 160 comprises a generally straight tube that extends across the exterior side of rear wall 116 to connect pump outlet 154 to jet nozzles 120. The outlet manifold of the disclosed embodiment comprises a square or rectangular cross-section; however, the tubing of the outlet manifold can comprise a cross-section of virtually any shape. Pump motor 156 protrudes axially from the pump housing in a direction generally parallel to right side wall 112.

Fluid is drawn into pump inlet 152 in a first inlet direction that is generally orthogonal to side wall 112. The fluid is then discharged from pump outlet 154 in a second direction that is generally parallel to the inlet direction. The fluid is discharged directly into outlet manifold 160 which extends in the direction of the fluid path. Because the fluid is not diverted by the outlet manifold, the efficiency of the pump is greatly increased.

Figure 5:
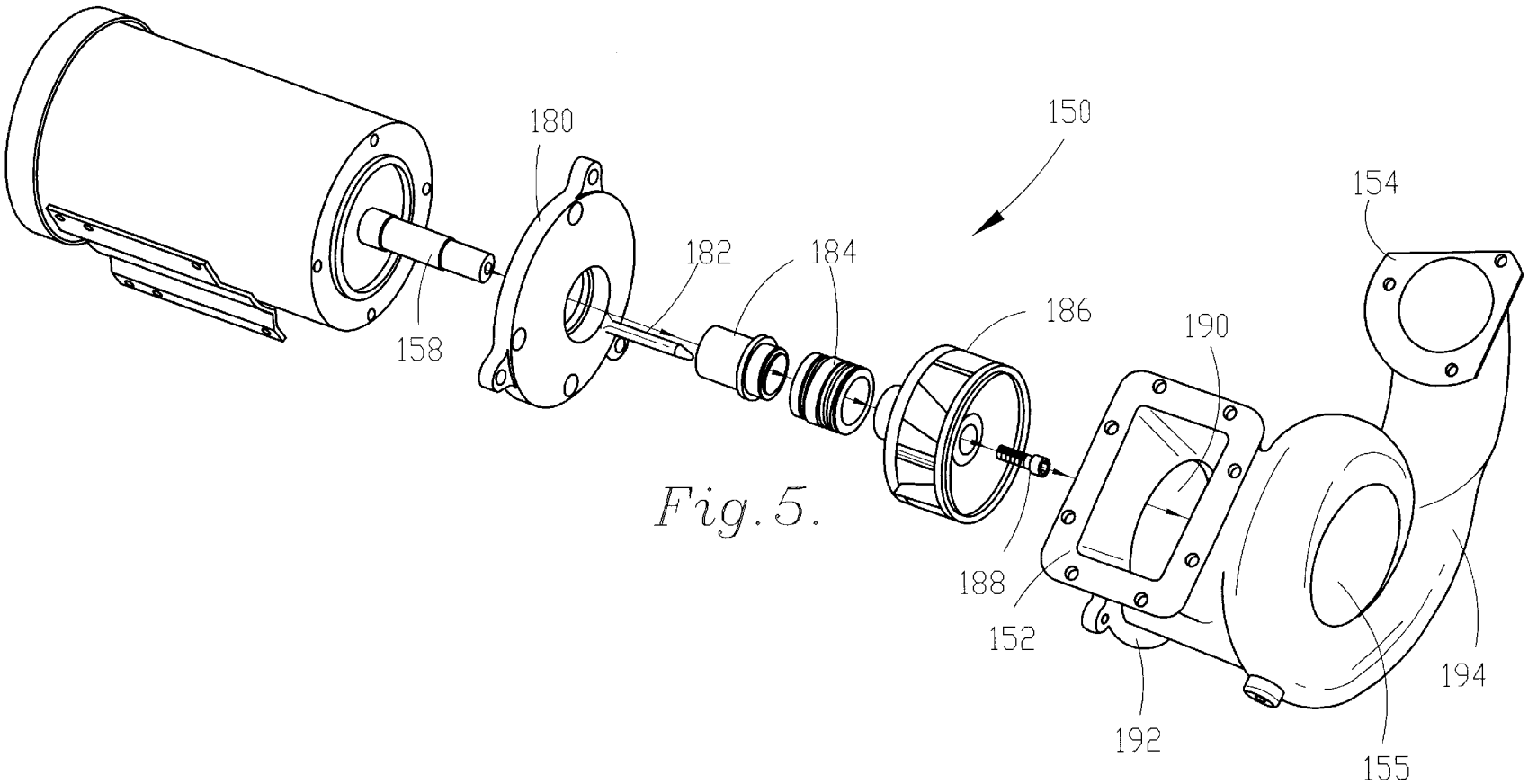
FIG. 5 is an exploded perspective view of an inventive pump for the pot and pan washing machine of the instant invention.
Figure 6:
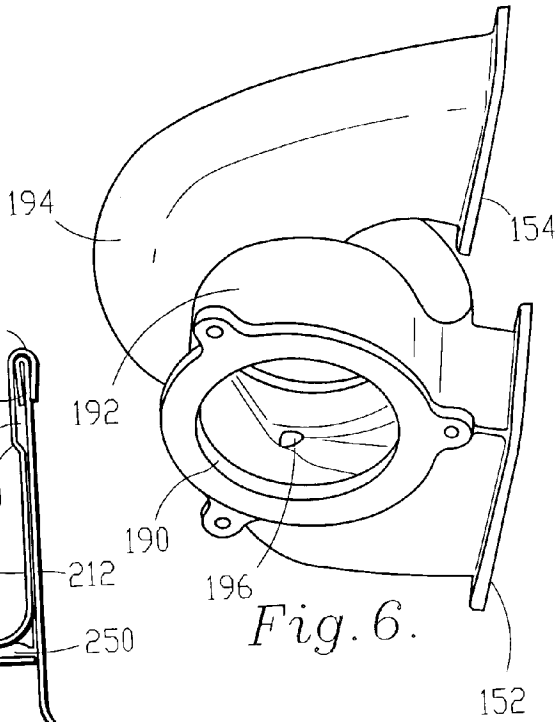
Figure 8:
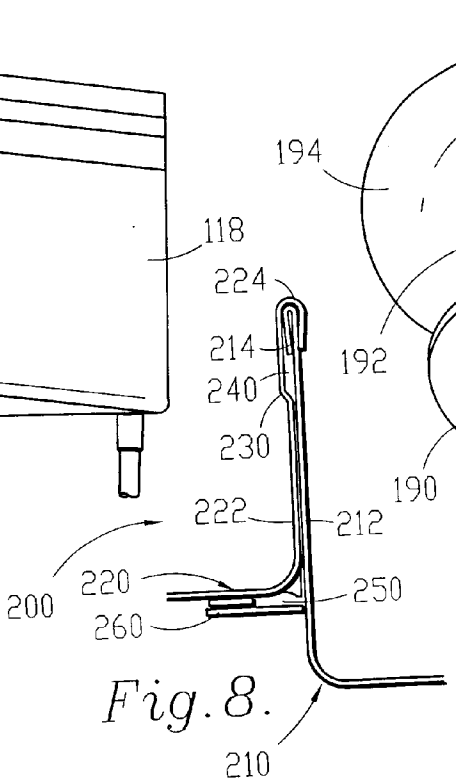
Figure 3:
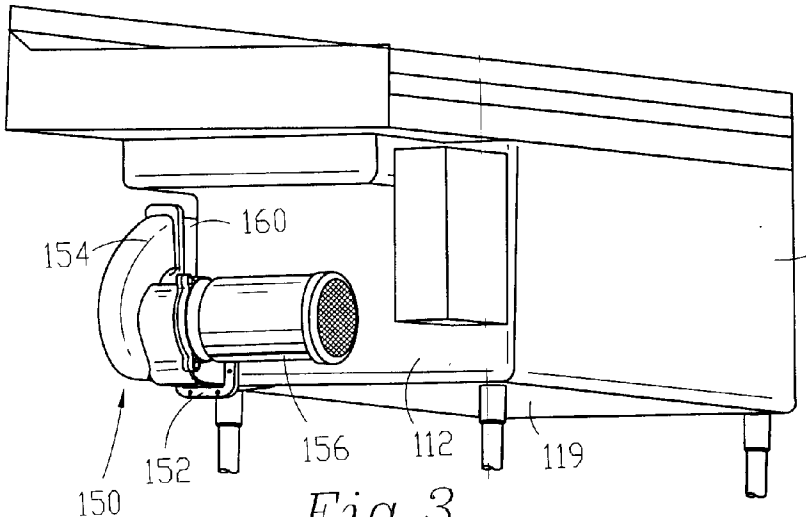
Figure 5:
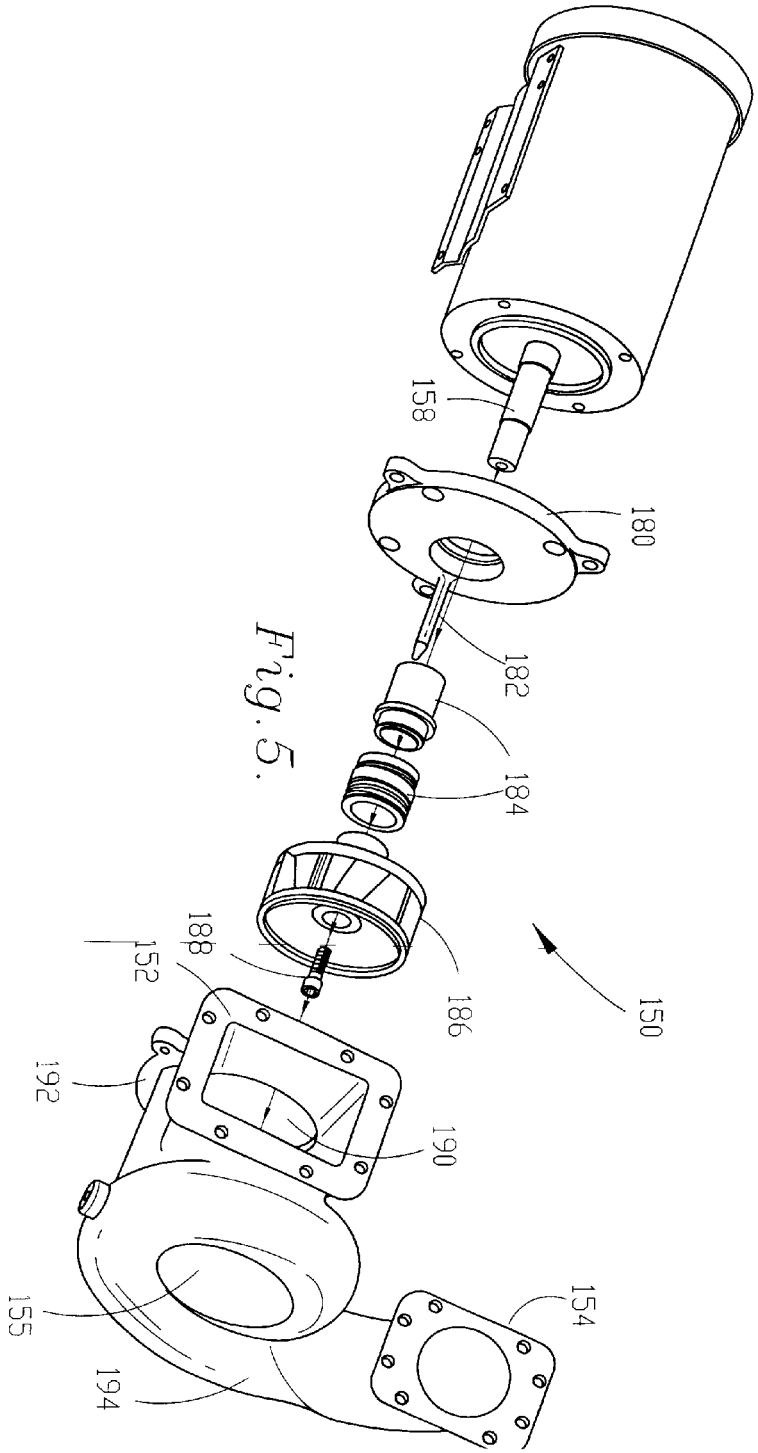

FIG. 5 shows an exploded view of pump 150 assembly of the instant invention. Rotatable shaft 158 extends axially from the inner end of pump motor 156. Generally annular seal plate 180 fits over shaft 158 for engagement with the inner end of pump motor 156. The seal plate is bolted or otherwise fastened to the inner end of pump motor 156. After seal plate 180 is associated with the pump motor, annular shaft seal 184 is positioned along shaft 158 in close engagement with seal plate 180. Impeller 186 is positioned on the end of shaft 158 in contact with seal 184, and bolt 188 is inserted through the center of impeller 186 and into threaded engagement with interior threads of shaft 158. The bolt is torqued to provides tight engagement of the impeller with the shaft and seal 184 resulting in a water-tight enclosure surrounding shaft 158.

Once the impeller, seal and seal plate are properly connected to motor 156, the entire assembly (motor, seal plate, seal and impeller) can be connected to the pump housing. Pump housing 155 is a generally helical housing including intake chamber 192 and raised volute 194. A cylindrical passage extends axially through both chamber 192 and volute 194 of housing 155. Volute 194 is in an axially raised position relative to chamber 192. The motor assembly is inserted, impeller first, into cylindrical passage 190 of housing 155. Impeller 186 will extend into volute 194. Anti-rotational cross-member 182 extends from seal plate 180 into chamber 192 in a direction generally perpendicular to the seal plate. Seal plate 180 is bolted or otherwise attached to housing 155 to provide a water tight seal between the housing and motor 156.

As is shown in FIG. 6, drainage passage 196 extends from the lower most portion of volute 194 into chamber 192. The lower most wall of the chamber angles downward toward inlet 152. As is shown in FIG. 4, the pump is mounted to the wash tank such that the bottom portion of intake port 152 is the lower most position of pump housing 155. Therefore, when the pump motor is not operating, gravitational forces will drive all water within volute 194 through drainage passage 196, into chamber 192, down the lower wall of chamber 192 and out pump inlet 152 into the wash tank. Thus the pump of the preferred embodiment is self-draining when not in use. This provides for improved sanitary conditions and increased pump life.

In operation, A/C motor 156 is energized to rotate shaft 158. Shaft 158 rotates impeller 186. The impeller has an enclosed face which results in shaft-side suction for the impeller. Water is drawn into chamber 192 from the shaft side of impeller 186. The impeller creates a rotational movement of fluid within chamber 192. Anti-rotation member 182 directs the rotating fluid from the chamber into volute 194. The fluid is thrust into volute 194 through the vanes of the rotating impeller. Volute 194 directs the fluid outward where it is discharged into outlet manifold 160.

The motor, seal plate, shaft seal and impeller can be removed as a single unit for easy servicing. Because the pump motor extends axially from the housing, and parallel to the side of the wash tank, the motor assembly can be easily removed and replaced regardless of space limitations to the side of the wash tank.

Intake Manifold and Flush Mounted Jet Nozzles

Intake manifold 130 is shown installed within wash tank 110 in FIG. 2. Intake manifold 130 includes an upper portion 132 extending outwardly from rear wall 116 toward front wall 118, and lower portion 134 extending from the front end of upper portion 132. In the preferred embodiment, the upper portion of intake manifold 130 is angled downward from rear wall 116. The downward angle of the upper portion of intake manifold 130 corresponds to the downward angle of jet nozzle 120 which directs a fluid path toward the front portion of bottom wall 119 as described above with respect to the prior art washing machine.

Portions of the intake manifold are perforated to allow fluid to be drawn into manifold 130 by the pump. The amount of perforations can vary depending upon the amount of vacuum desired and the flow rate of the pump. Increasing the number and size of the perforations will result in a decreased vacuum and increased efficiency. Perforations can be located only on upper portion 132, only on lower portion 134, or on both upper portion 132 and lower portion 134.

The jet nozzles of the preferred embodiment are flush mounted to rear wall 116 of the wash tank. An annular outer ring 122 is mounted to rear wall 116 on the inner side of the wash tank. Directing tube 126 extends from an inner circumference of outer ring 122, through a hole in rear wall 116 and into outlet manifold 160. The directing tube diverts the fluid path moving through the outlet manifold into a jet stream. The directing tube has a predetermined angle to direct the jet stream toward the front portion of bottom wall 119. Semi-circular splash shield 124 extends in a generally orthogonal direction from outer ring 122. The outer ring can be mounted to rear wall 116 with any suitable means, including bolts or screws. In the preferred embodiment, threaded shafts 128 extend from outer ring 122 in a generally perpendicular direction through rear wall 116. Bolts can be threaded onto threaded shafts 128 from the outer side of rear wall 116, leaving jet nozzle 120 with a clean, unobstructed surface inside the wash tank. In an alternate embodiment, directing tube 126 can be mounted directly to the rear wall of the wash tank by welding or any other suitable means of connection.

In the preferred embodiment of the instant invention, upper portion 132 of the intake manifold is positioned within the fluid path of nozzle 120. The jet stream from flush mounted nozzle 120 impacts the intake manifold at a position generally near rear wall 116 and skims across the surface of the upper portion of intake manifold 130. Intake manifold 130 is thereby self-cleaning in that jet nozzle 120 blows any debris away from the perforations of the intake manifold. The preferred embodiment of the intake manifold includes the upper and lower portions that are connected to rear wall 116 and bottom wall 119, respectively to form an inclosure within the intake manifold. Additional walls can be utilized if it is not desired to have the intake manifold connected to both the rear and bottom walls. The intake manifold can be made removable in a manner similar to that of the prior art; however, since the preferred embodiment is self-cleaning (described above), the inventive intake manifold can be permanently connect within the wash tank using any means known in the art. A heater can be positioned within the intake inclosure for safety and protection.

In operation, wash tank 110 is filled full of water, soap and pots and pans to a level above jet nozzles 120. The soapy water, or fluid is drawn through the perforations in intake manifold 130 by pump 150. The fluid enters pump 150 through inlet 152 in a first direction that is generally parallel to rear wall 116. The fluid is discharged from the pump through outlet 154 into outlet manifold 160. Jet nozzle 120 diverts the fluid from the outlet manifold into a jet stream directed toward the front portion of bottom wall 119. The jet stream skims across the upper portion of intake manifold 130 as it travels from the jet nozzle to the bottom wall of the wash tank. The jet stream is deflected from bottom wall into a wash action in a manner substantially similar to that of the prior art.

The pot and pan washing machine of the instant invention and its components are all preferably constructed of stainless steel to increase the life of the machine; however, any other suitable material known in the art may also be utilized.

Non-Welded Field Joint

FIG. 8 shows the non-welded field joint of the instant invention. Field joint 200 is utilized to connect two separate sink portions of a pot and pan washing machine system together as a single unit. The sink portions that can be connected by the inventive field joint include but are not limited to sink basin to sink basin, sink basin to counter top, and counter top to counter top.

In FIG. 8, field joint 200 is used to provide a sink basin to sink basin connection. Hemmed edge 214 is formed along an edge of a generally flat side, 212, of first sink basin 210. Lip 224 is formed along an edge of a generally flat side, 222, of second sink basin 220. Jog 230 is located generally near the edge of side 222 and extends inwardly, towards the inside of sink basin 220 and positions lip 224 generally inward of side 222. (alternatively, the inwardly extending jog could be located near the edge of side 212 to position hemmed edge 214 generally inward of side 212).

During an installation, the two sink basins are brought together into close engagement with one another. Lip 224 is positioned over hemmed edge 214 such that lip 224 surrounds hemmed edge 214. The displacement caused by inwardly extending jog 230 will result in forcing side 212 and side 222 into tight engagement with one another.

No gaps will be present where the generally flat portions of sides 212 and 222 are brought into engagement. Nevertheless, gap 240 will be present between the inwardly extended portion of jog 230 and the generally flat portion of side 212. This gap can be filled with silicon or some other suitable sealant during installation. Other gaps may exist where surfaces that are not flat coincide with the flat portions of sides 212 and 222. For example, gap 250 is formed where the bottom side of sink basing 220 coincides with sides 212 and 222. This gap can also be filled with silicon. Additionally, trim piece 260 can be attached to sink basin 220 using 3M™ VHB™ tape, or any other suitable adhesive that is known in the art. Additional trim pieces may be utilized to conceal the field joint and thus increase the aesthetic appearance of the assembly.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

Having now described the features, discoveries and principles of the invention, the manner in which the inventive pot and pan washing machine is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

Having thus described the invention what is claimed as new and desired to be secured by Letters Patent is as follows:

1. A pot and pan washing machine comprising:

a wash tank including bottom wall, a rear wall, a front wall and two side walls extending upwardly from said bottom wall;

an intake port in one of said walls, said intake port being located adjacent to said bottom wall;

an outlet manifold adjacent to said rear wall;

a parallel flow pump including:

a pump inlet associated with said intake port, said pump inlet having an intake path in a first direction, and a pump outlet associated with said outlet manifold, said pump outlet having an outlet path in a second direction, said second direction being generally parallel to said first direction;

a perforated intake manifold positioned to cover said intake port; and at least one jet nozzle in association with said outlet manifold to expel at a predetermined angle a jet stream of fluid from said outlet manifold.

2. The pot and pan washing machine as claimed in claim 1 wherein said parallel flow pump is self-draining.

3. The pot and pan washing machine as claimed in claim 1 wherein said intake manifold is located adjacent said rear wall.

4. The pot and pan washing machine as claimed in claim 1 wherein said intake manifold comprises:

an upper portion extending away from said rear wall towards said front wall at a predetermined downward angle towards said bottom wall, said upper portion is positioned within a portion of the jet stream of said jet nozzle and said predetermined downward angle of said upper portion of said intake manifold corresponds to the predetermined angle of the jet stream of said nozzle.

5. The pot and pan washing machine as claimed in claim 4 wherein said jet nozzle comprises:

a directing tube flush connected to said rear wall and extending into said outlet manifold.

6. The pot and pan washing machine as claimed in claim 5 wherein said directing tube is connected to said rear wall via an outer ring that is flush mounted to an inner side of said rear wall.

7. The pot and pan washing machine as claimed in claim 1 wherein said jet nozzle comprises:

a directing tube flush connected to said rear wall and extending into said outlet manifold.

8. The pot and pan washing machine as claimed in claim 7 wherein said directing tube is connected to said rear wall via an outer ring that is flush mounted to an inner side of said rear wall.

9. A pot and pan washing machine comprising:

a wash tank including a bottom wall, a rear wall, a front wall and two side walls extending upwardly from said bottom wall;

an intake port in one of said side walls, said intake port being located adjacent to said bottom wall;

an outlet manifold adjacent to said rear wall; a pump including:

a pump inlet associated with said intake port, and a pump outlet associated with said outlet manifold;

at least one jet nozzle in association with said outlet manifold to expel at a predetermined angle a jet stream of fluid from said outlet manifold; and a perforated intake manifold within said wash tank positioned along said rear wall and within a portion of the jet stream of said jet nozzle and positioned to cover said intake port, said intake manifold including an upper portion extending in a direction generally originating from said rear wall towards said front wall at a predetermined downward angle towards said bottom wall, and said predetermined downward angle of said upper portion of said intake manifold corresponds to the predetermined angle of the jet stream of said nozzle.

10. The pot and pan washing machine as claimed in claim 9 wherein said upper portion of said intake manifold includes perforations.

11. The pot and pan washing machine as claimed in claim 9 wherein said jet nozzle comprises:

a directing tube flush connected to said rear wall and extending into said outlet manifold.

12. The pot and pan washing machine as claimed in claim 11 wherein said directing tube is connected to said rear wall via an outer ring that is flush mounted to an inner side of said rear wall.

13. The pot and pan washing machine as claimed in claim 9 wherein said upper portion of said intake manifold abuts said rear wall.

14. The pot and pan washing machine as claimed in claim 9 wherein said intake manifold further comprises a lower portion, said lower portion extending perpendicularly from said upper portion, said lower portion abutting said bottom wall.

15. The pot and pan washing machine as claimed in claim 14 wherein said lower portion of said intake manifold is perforated.

16. A pot and pan washing machine comprising:

a wash tank including a bottom wall, a rear wall, a front wall and two side walls extending upwardly from said bottom wall;

an intake port in one of said side walls, said intake port being located adjacent to said bottom wall;

an outlet manifold adjacent to said rear wall;

a pump including:

a pump inlet associated with said intake port, and a pump outlet associated with said outlet manifold;

at least one jet nozzle in association with said outlet manifold to expel at a predetermined angle a jet stream of fluid from said outlet manifold, said jet nozzle including:

a directing tube flush connected at an outer end to said rear wall and including an inner end extending into said outlet manifold; and a perforated intake manifold within said wash tank positioned to cover said intake port.

17. The pot and pan washing machine as claimed in claim 16 wherein said directing tube is connected to said rear wall via an outer ring that is flush mounted to an inner side of said rear wall.

18. The pot and pan washing machine as claimed in claim 16 wherein said jet nozzle further comprises a semi-circular splash guard protruding from said outer ring in a generally orthogonal direction.

19. A pot and pan washing machine comprising:

a wash tank including bottom wall, two sidewalls and two end walls extending upwardly from said bottom wall, said side walls being longer than said end walls;

an intake port in one of said walls, said intake port being located adjacent to said bottom wall;

an outlet manifold adjacent to one of said side walls; a parallel flow pumping system including:

a pumping system inlet associated with said intake port, said pump inlet having a linear intake path in a first direction, and a pumping system outlet associated with said outlet manifold, said pump outlet having a linear outlet path in a second direction, said second direction being generally parallel to said first direction;

a perforated linear intake manifold extending in said first direction and positioned to cover said intake port; and at least one jet nozzle in association with said outlet manifold to expel at a predetermined angle a jet stream of fluid from said outlet manifold.

* * * * *

UNITED STATES PATENT AND TRADEMARK OFFICE

CERTIFICATE OF CORRECTION

PATENT NO. : 6,739,348 B2
DATED : May 25, 2004
INVENTOR(S) : John Inch et al.

It is certified that error appears in the above-identified patent and that said Letters Patent is hereby corrected as shown below:

Drawings,
Sheets of drawings consisting of figures 3, 5, 8 and 6, should be deleted to appear as attached figures.

Column 12,
Line 41, "an intake port in one of said side walls, said intake port"; should read -- an intake port in one of said walls, said intake port --.

Column 13,
Line 1, "an intake port in one of said side walls, said intake port"; should read -- an intake port in one of said walls, said intake port --;

Signed and Sealed this

Twenty-eighth Day of September, 2004

JON W. DUDAS
*Director of the United States Patent and Trademark Office*